United States Patent [19]

Paddock et al.

[11] 4,449,109

[45] May 15, 1984

[54] MAGNET SUPPORT COLLAR

[75] Inventors: Kimberly A. Paddock, Blaine; Roy L. Ruth, Moundsview, both of Minn.

[73] Assignee: Ball Corporation, Muncie, Ind.

[21] Appl. No.: 439,696

[22] Filed: Nov. 8, 1982

[51] Int. Cl.[3] ..... H01F 1/00

[52] U.S. Cl. ..... 335/212; 313/431

[58] Field of Search ..... 335/210, 212, 211; 313/426, 431, 430, 427, 428

[56] References Cited

U.S. PATENT DOCUMENTS

| | | | |
|---|---|---|---|
| 2,717,323 | 9/1955 | Clay | 335/212 X |
| 2,854,598 | 9/1958 | Baermann | 313/430 |
| 2,972,074 | 2/1961 | Vasilevskis | 335/212 |
| 3,106,658 | 10/1963 | Chandler et al. | 313/77 |
| 3,296,570 | 1/1967 | Uetake et al. | 335/212 |
| 4,197,487 | 4/1980 | Takenaka et al. | 315/370 |
| 4,198,614 | 4/1980 | Ragland | 335/211 |

*Primary Examiner*—George Harris

*Attorney, Agent, or Firm*—Gilbert E. Alberding

[57] ABSTRACT

A magnetic compensation device is disclosed for use with a cathode ray tube which includes a strip having a plurality of holes distributed linearly along the strip. A plurality of fasteners, each fastener comprising a base and a shaft substantially perpendicular to the base, passes through a selected one of the holes in the supporting strip. At least one of the fasteners engages two holes in opposite ends of the strip to hold the strip in a hoop shape. The strip is adhesively secured to a deflection yoke. A plurality of ring-shaped magnets are provided with one such magnet being received on the shaft of selected fasteners. The washer-shaped permanent magnets are positioned about the deflection yoke at equal angles with the axis of rotation of the magnets lying in planes transverse to the central axis of the cathode ray tube.

12 Claims, 5 Drawing Figures

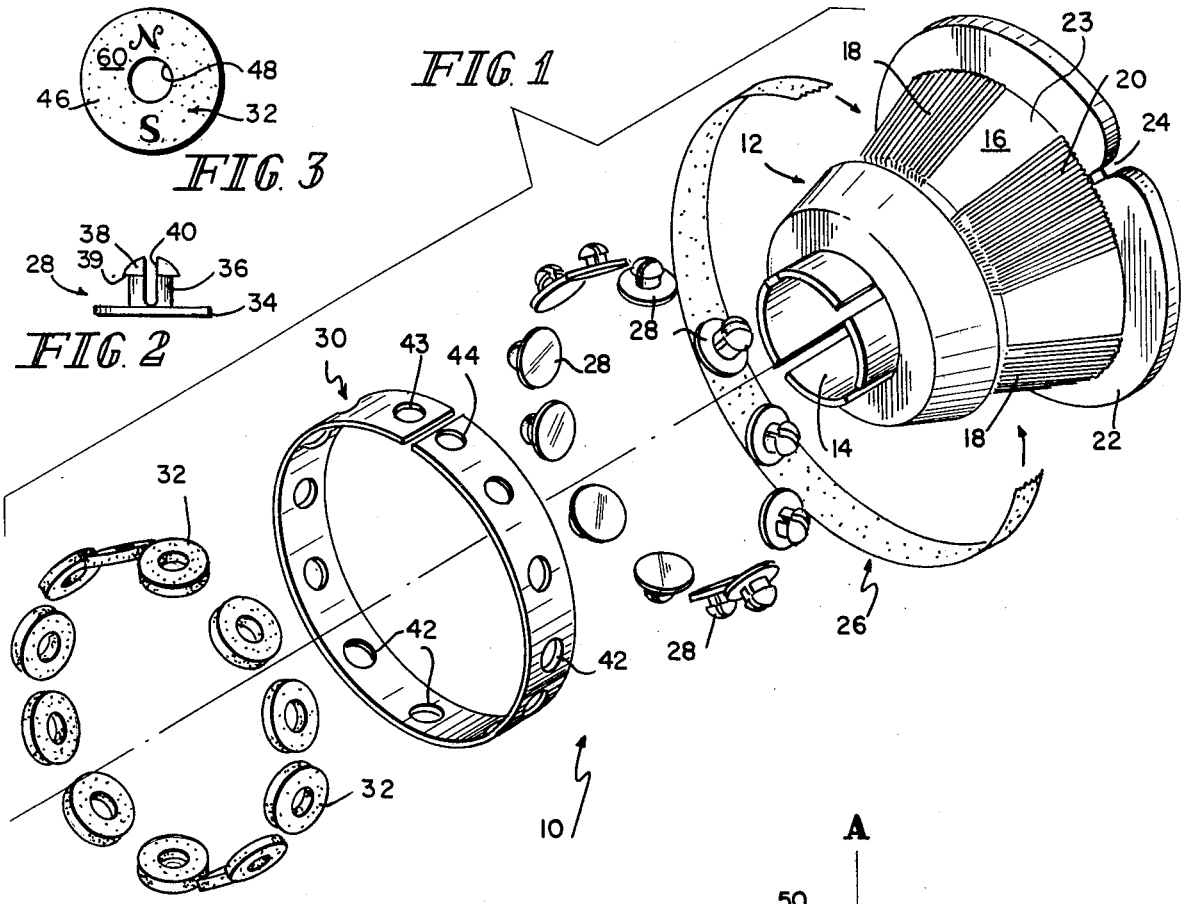
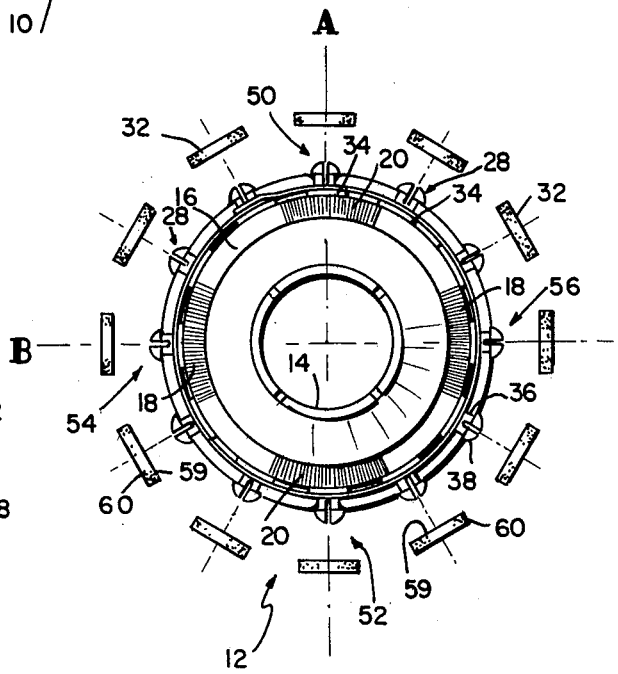
FIG. 4
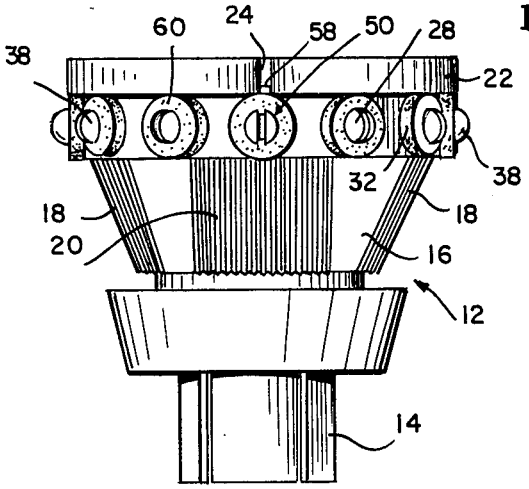
FIG. 5

MAGNET SUPPORT COLLAR

The present invention relates generally to permanent magnets used to deflect electrons or ion beams. The invention relates more particularly to a means for supporting permanent magnets which are adjustably positioned with respect to a cathode ray tube so as to achieve electron beam centering, multiple-beam convergence, and the like.

The use of adjustably positioned, disk-shaped, permanent magnets in connection with cathode ray tubes for beam centering, multiple-beam convergence, and the like is well known. By way of example, Uetake et al U.S. Pat. No. 3,296,570 discloses a device for correcting the distortion of deflection in television picture tubes. The device consists essentially of a strip of brass sheet formed into an annular supporting ring surrounding the deflection coil on the back of the picture tube. Four C-shaped holders are mounted on the supporting ring and within each C-shaped holder is situated a disk-shaped permanent magnet. The permanent magnet has a central square hole into which an appropriate tool may be inserted for the purpose of rotating the magnet about its longitudinal axis. The disk-shaped permanent magnets are said to have a north and a south pole on a peripheral surface and the north and south poles are illustrated to be diametrically opposite each other.

A further example of the prior art is found in Chandler et al U.S. Pat. No. 3,106,658 which shows a similar ring-like holder 21 composed of four ferromagnetic strips placed end-to-end circumferentially around the cone of the picture tube. Four disk-shaped magnets which are said to be polarized along a diameter of the disk are fixed to the circumferential support ring by an appropriate bracket. The Chandler support ring of ferromagnetic material is intended to more actively couple the magnetic field provided by the four magnets than did the brass-supporting ring of the Uetake apparatus.

A further example is found in Takenaka et al U.S. Pat. No. 4,197,487 which discloses a ring-like support surrounding the deflection yoke of a picture tube which includes six permanent magnets, each of which comprises a disk-shaped permanent magnet having a pair of poles again shown to be diametrically opposed. In each of the disclosures, it is assumed that the magnets are to be adjusted so as to focus, deflect, or converge the electron beam or beams within the picture tube.

In accordance with the present invention, a charged particle deflecting device is provided which comprises a plurality of fasteners. Each of the fasteners comprises a base and a shaft substantially perpendicular to the base. A strip is provided having a multiplicity of holes linearly distributed therealong. The shafts of the fasteners pass through the strip in a plurality of the holes. A selected number of ring-shaped magnets is provided, with one such magnet being received on the shaft of each of the same selected number of fasteners.

In a preferred embodiment, the strip is arranged in a hoop configuration with two ends of the strip overlapping, with at least one of the fasteners engaging two holes near the opposite ends of the strip. Further, an adhesive means is provided of about the same length as the strip which underlies the plurality of fasteners for retaining the deflecting device in a fixed position relative to a supporting surface.

One feature of the instant invention is that the collar supports a plurality of low-cost magnets. Due to the low cost of the individual magnets, a large number of magnets can be used at relatively low cost. This feature has the advantage of permitting the designers and manufacturers of deflection yokes to create a more uniform design for their deflection yokes. This reduces the diversity of deflection yokes which must be kept in a manufacturer's inventory, and also tends to reduce research and development time to design a large number of diverse deflection yokes.

Another feature of the instant invention is that the magnets are adjustable to adjust the field in the deflection yoke through which the electrons travel. This feature has the advantage of enabling designers of deflection yokes to design yokes which are optimized for resolution without forcing the designers to also correct for display geometry in their designs. Because of the number of positions available for magnets on the support collar, positioning of the magnets is no longer necessary as a part of the geometric correction operation. A simple turn of a magnet or magnets in its respective position on the collar is the only adjustment needed to make the deflection yoke geometrically correct.

Because the magnets are held onto the fastener, which is held onto the support collar, and because the magnets are rotatable on the fasteners, it becomes possible to simultaneously turn more than one magnet. This serves to accelerate the adjustment operation while permitting the adjuster to cancel interactive forces that tend to reverse previous settings when a single magnet is positioned. When magnets are secured to the fasteners, they will normally be held firmly in a set position. By exerting a rotational force on the magnet, however, the magnet can be moved from its set position while secured upon the fastener and rotated to a position of proper adjustment.

It is also a feature of this invention that the time wherein the magnets can be adjusted is not constrained by the curing time of the adhesive which fastens the collar to the yoke. This feature has the advantage of enabling the person adjusting the magnets to perform their adjustments at any time after the adhesive has cured. Further, the adjustment operation is not complicated by the presence of messy adhesives.

A further feature of the instant invention is that the collar and magnets are designed to be space-saving. The low profile of the flexible collar with the magnets installed has the advantage of requiring no more space in the cathode ray tube's display assembly than is normally required for a deflection yoke without the collar and magnet assembly. Further, cathode ray tube display assemblies requiring shields over the deflection yoke can continue to use the same shields over a yoke containing the collar and magnet assembly. This can be done without requiring any mechanical modification or change in the method of installation of the shield upon the yoke assembly.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which:

FIG. 1. is an exploded perspective view of the invention;

FIG. 2 is a side view of a fastener;

FIG. 3 is a top view of a magnet;

FIG. 4 is a partially exploded end view of the collar as placed upon the deflection yoke; and FIG. 5 is a top view of the invention.

A charged particle deflecting device 10 for correcting deflection distortion of an electron beam in a cathode ray tube is shown in FIG. 1 along with a deflection yoke 12. Deflection yoke 12 includes an electron generator 14 for generating a stream of electrons, a deflection coil support form 16, and horizontal deflection coils 18 and vertical deflection coils 20 which are supported upon the deflection coil support form 16. Disposed forwardly upon deflection coil support form 16 is circumferential lip 22 which includes a locator notch 24 which serves to help position the charged particle deflecting device 10 on the deflection coil support form 16.

Charged particle deflecting device 10 includes an adhesive strip 26 which may be formed from any relatively non-flammable double-sided strip adhesive tape and is preferably composed of a curable adhesive such as organic silicone polymer. Fasteners 28 are provided which include a disk-shaped base portion 34, a cylindrical shaft portion 36, and an enlarged distal end or head 38. The enlarged head may be mushroom-shaped as shown in FIG. 2 and include a retaining lip 39 which is substantially perpendicular to the axis of cylindrical shaft 36. Slot 40 extends across mushroom-shaped head 38, and downwardly into cylindrical shaft 36, causing mushroom-shaped head 38 to be fully bifurcated and cylindrical shaft 36 to be partially bifurcated. A plurality of fasteners 28 are provided and, in a preferred embodiment, twelve fasteners 28 are provided. A collar 30 is provided which can be composed of any polymeric material having sufficiently low flammability and is preferably constructed of a polyurethane having a UL flammability rating of 94V-2 or better. Collar 30 includes a plurality of holes 42 including end holes 43, 44. In the preferred embodiment, the collar 30 includes one more hole than the number of fasteners. The collar 30 is arranged in a hoop configuration with the two holes 43 and 44 overlapping with a single fastener 28 engaging the two holes 43 and 44.

The charged particle-deflecting device 10 is installed upon the deflection yoke 12 as shown in FIGS. 4 and 5. The bifurcated halves of enlarged mushroom-shaped head 38 of fastener 28 are squeezed together and placed through the holes 42 of the collar 30. The fasteners 28 are all placed in the same orientation so that the disk-shaped base portions 34 of the fasteners 28 are all disposed in the same surface of collar 30.

Adhesive strip 26 is placed on the front outside circumferential surface 23 of the deflection yoke 12 adjacent circumferential lip 22. The collar 30 and fasteners 28 are then placed over the adhesive strip 26 with the disk-shaped portion 34 of the fasteners 28 being in contact with the adhesive strip 26.

As collar 30 is being brought around the adhesive strip, the fastener 28 which extends through end hole 44 is inserted into open end hole 43 to form a complete ring around the outside circumferential surface of the deflection yoke 12 adjacent to circumferential lip 22. Before the adhesive strip 26 has fully cured, the collar 30 is rotationally positioned upon the outside circumferential surface of the deflection yoke 12 so that the top fastener 50 and bottom fastener 52 are aligned with the axis of vertical deflection A and the side fasteners 54, 56 are aligned with the axis of horizontal deflection B. In a preferred embodiment, twelve fasteners are positioned about the deflection yoke assembly at equal angles of 30°.

A plurality of the ring-shaped magnets 32 are provided having a ring portion 46 and a central aperture 48 which is sized and shaped to be received on the cylindrical shaft portion 36 of fastener 28. The strength and quantity of washer-shaped magnets 32 are selected and installed as required to satisfy a particular cathode ray tube display specification. Preferably, magnets 32 are dipolar permanent magnets having diametrically opposed north and south poles.

Referring now to FIG. 5, in a preferred embodiment, the collar contains a protuberance 58 which is sized to be received into notch 24 on circumferential lip 22 which aids the installer in rotationally positioning the collar 30 on the deflection yoke. One ring-shaped permanent magnet 32 is placed over each fastener. As the central aperture 48 of each magnet 32 engages the bifurcated mushroom-shaped head 38 of each fastener 28, the width of the slot 40 decreases to allow the central aperture 48 to fit over the head 38 to a position wherein the lower surface 59 of magnet 32 is in contact with the collar 30 and the upper surface 60 of magnet 32 is being retained on the fastener 28 by the retaining lip 39 of the mushroom-shaped head 38. Preferably, the magnets 32 are inserted onto the fasteners 28 after any curable adhesive has cured until the collar 30 will not become displaced from its position upon the outside circumferential surface of the deflection yoke 12 when the magnets 32 are installed upon the fasteners 28. The magnets 32 are rotatably attached to fasteners 28, having axes of rotation lying in a plane transverse to the central axis of the cathode ray tube and are individually or collectively rotated by the operator to adjust the display geometry of the cathode ray tube.

Although the invention has been described in detail with reference to certain preferred embodiments as specific examples, variations and modifications exist within the scope and spirit of the invention as described and as defined in the following claims.

What is claimed is:

1. Apparatus for correcting deflection distortion of an electron beam in a cathode ray tube assembly comprising:

an elongated strip extending around said cathode ray tube assembly, said elongated strip having a plurality of holes distributed along the length thereof;

a plurality of fasteners, each of said plurality of fasteners including a base portion and a shaft portion substantially perpendicular to said base portion, the shaft portion of each of said fasteners extending through a hole in said elongated strip, at least a portion of each shaft portion being bifurcated by a vertical slot;

a plurality of ring-shaped permanent magnets, each of said magnets being supported on the shaft portion of one of said plurality of fasteners, said bifurcated portion permitting easy insertion of said magnets onto said shaft portions while retaining said magnets in position thereon; and means for attaching said elongated strip to said cathode ray tube assembly.

2. Apparatus as recited in claim 1 wherein said attaching means comprises an adhesive strip extending around said assembly, said adhesive strip having adhesive on both sides thereof for attachment to said assembly and to the base of each of said said fasteners.

3. Apparatus as recited in claim 1 and further including means for rotationally positioning said elongated strip relative to said assembly.

4. Apparatus as recited in claim 3 wherein said rotational positioning means comprises a protuberance on one of said elongated strip or said assembly adapted to be received in a notch in the other of said elongated strip or said assembly.

5. Apparatus as recited in claim 1 wherein one of said fasteners extends through two holes located at opposite ends of said elongated strip for holding the ends of said elongated strip together.

6. A deflection yoke assembly for a cathode ray tube comprising a deflection yoke for deflecting an electron beam in said cathode ray tube, and a compensating device for correcting deflection distortion of said electron beam, said compensating device including:

an elongated strip extending around the circumference of said deflection yoke, said strip having a plurality of holes extending therethrough and distributed substantially linearly along the length of said strip;

a plurality of fastener means, each of said plurality of fastener means including a base portion and a shaft portion substantially perpendicular to said base portion, the shaft portion of each of said fastener means extending through one of said plurality of holes;

a plurality of ring-shaped permanent magnets, each of said plurality of magnets being supported on the shaft portion of one of said plurality of fastener means; and an adhesive strip extending around the circumference of said deflection yoke and underlying said elongated strip, said adhesive strip containing adhesive on both sides thereof for attachment to both said deflection yokes and to the bases of said fastener means.

7. An assembly as recited in claim 6 and including protuberance means on one of said deflection yoke or elongated strip adapted to be received in notch means in the other of said deflection yoke or elongated strip for rotationally positioning said elongated strip relative to said deflection yoke.

8. An assembly as recited in claim 6 wherein said adhesive comprises a curable adhesive.

9. An assembly as recited in claim 6 wherein at least a portion of said shaft portion is bifurcated by a vertical slot to permit easy insertion of said magnets onto said shaft portions while retaining said magnets in position thereon.

10. A method for mounting an electron beam deflection device to the deflection yoke of a cathode ray tube comprising:

providing an elongated flexible strip having a plurality of holes extending therethrough;

extending a fastener through each of said plurality of holes, each of said fasteners including a shaft portion extending through said holes;

placing an adhesive strip around the circumference of said deflection yoke;

placing said flexible strip with said fasteners thereon around the circumference of said deflection yoke over said adhesive strip for adhering said fasteners to said adhesive strip;

positioning a ring-shaped magnet on each of said shaft portions; and rotating one or more of said magnets to adjust the magnetic field in said cathode ray tube to control the deflection of said electron beam.

11. A method as recited in claim 10 and further including the step of curing the adhesive on said adhesive strip for adhering said fasteners to said adhesive strip and said adhesive strip to said deflection yoke.

12. A method as recited in claim 10 and further including the step of rotationally aligning said flexible strip relative to said deflection yoke prior to said curing step.

* * * * *